US011885558B2

(12) United States Patent
Shetty

(10) Patent No.: US 11,885,558 B2
(45) Date of Patent: Jan. 30, 2024

(54) SEALING ASSEMBLY FOR REFRIGERATOR

(71) Applicant: WHIRLPOOL CORPORATION, Benton Harbor, MI (US)

(72) Inventor: Shekhar Shetty, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 120 days.

(21) Appl. No.: 17/317,081

(22) Filed: May 11, 2021

(65) Prior Publication Data

US 2022/0364785 A1 Nov. 17, 2022

(51) Int. Cl.
*F25D 23/08* (2006.01)
*F25C 1/00* (2006.01)

(52) U.S. Cl.
CPC ..... *F25D 23/087* (2013.01); *F25C 1/00* (2013.01)

(58) Field of Classification Search
CPC .... F25D 23/087; F25D 23/123; F25D 23/025; F25D 23/02; F25D 23/082; F25C 1/00
See application file for complete search history.

(56) References Cited

U.S. PATENT DOCUMENTS 4,617,759 A * 10/1986 Pasqualini et al. ... F25D 23/082 49/478.1
9,175,896 B2 11/2015 Choi
2005/0076575 A1* 4/2005 Cittadini et al. ..... F25D 23/087 49/498.1
2012/0319551 A1* 4/2012 Ramm et al. ..... F25D 23/087 312/405
2018/0187942 A1 7/2018 Hong et al.
2020/0003481 A1* 1/2020 Okazaki et al. ..... F25D 23/087
2020/0284500 A1* 9/2020 Aranda et al. ..... F25D 23/087

FOREIGN PATENT DOCUMENTS

KR 20060093762 A * 2/2005 ..... F25D 23/087
KR 100593088 B1 6/2006
KR 101485094 B1 1/2015

OTHER PUBLICATIONS

KR 20060093762 A Translation (Year: 2005).*
Engineering Toolbox Thermoplastics—Physical Properties Physical properties of thermoplastics like ABS, PVC, CPVC, PE, PEX, PB and PVDF (Year: 2005).*

* cited by examiner

*Primary Examiner* — Elizabeth J Martin
*Assistant Examiner* — Dario Antonio Deleon
(74) *Attorney, Agent, or Firm* — Brooks Kushman P.C.

(57) ABSTRACT

A refrigerator including a body, a door, configured to pivot about the body, a female sealing member, and a male sealing member. The body is provided with a first refrigerated compartment. The door may be configured to pivot between an open position, in which the refrigerated compartment is open, and closed position, in which the refrigerated compartment is closed. The female sealing member extends along portions of the body or portions of the door. The male sealing member extends along the other of the portions of the body or the door. When the door is in the closed position, the female sealing member receives the male sealing member.

19 Claims, 5 Drawing Sheets

SEALING ASSEMBLY FOR REFRIGERATOR

TECHNICAL FIELD

The present disclosure relates to a sealing assembly for use in a refrigerator.

BACKGROUND

Refrigerators may include a cabinet that defines a storage compartment and includes a refrigerator door that is pivotable about the cabinet between an open position and a storage position. The storage compartment may include a refrigerator compartment and a freezer compartment. The refrigerator may include an ice making assembly that generates and stores ice in cool air. The ice making assembly may be disposed in the refrigerator door so that a removable bin may be easily accessed and removed by a user.

SUMMARY

According to one embodiment, a refrigerator is provided. The refrigerator may include a body, a door configured to pivot about the body, a female sealing member, and a male sealing member. The body may be provided with a first refrigerated compartment. The door may be configured to move, such as pivot or translate between an open position, in which the refrigerated compartment is open, and a closed position, in which the refrigerated compartment is closed. The female sealing member may extend along portions of the body or portions of the door. The male sealing member may extend along the other of the portions of the body or the door. When the door is in the closed position, the female sealing member may receive the male sealing member.

According to another embodiment, a refrigerator is provided. The refrigerator may include a main body, a door configured to pivot about the body, a second door configured to pivot about the first door, a female sealing member, and a male sealing member. The second door may be configured to pivot between an open position, in which the second refrigerated compartment is accessible, and a closed position in which the second refrigerated compartment is inaccessible. The female sealing member may extend along portions of either the first door or portions of the second door. The male sealing member may extend along the other of the portions of the first door or portions of the second door. When the second is in the closed position, the male sealing member may be at least partially disposed in the female sealing member.

According to yet another embodiment, a sealing assembly for use in a refrigerator that may be provided with a body and a door configured to pivot about the body between an open position and a closed position. The sealing assembly may include a gasket socket and a gasket protrusion. The gasket socket may be configured to be disposed around an ice making storage assembly disposed within the body. The gasket protrusion may be configured to be fixed to the door and at least partially disposed in the gasket socket when the door is in the closed position.

DETAILED DESCRIPTION

Figure 1:
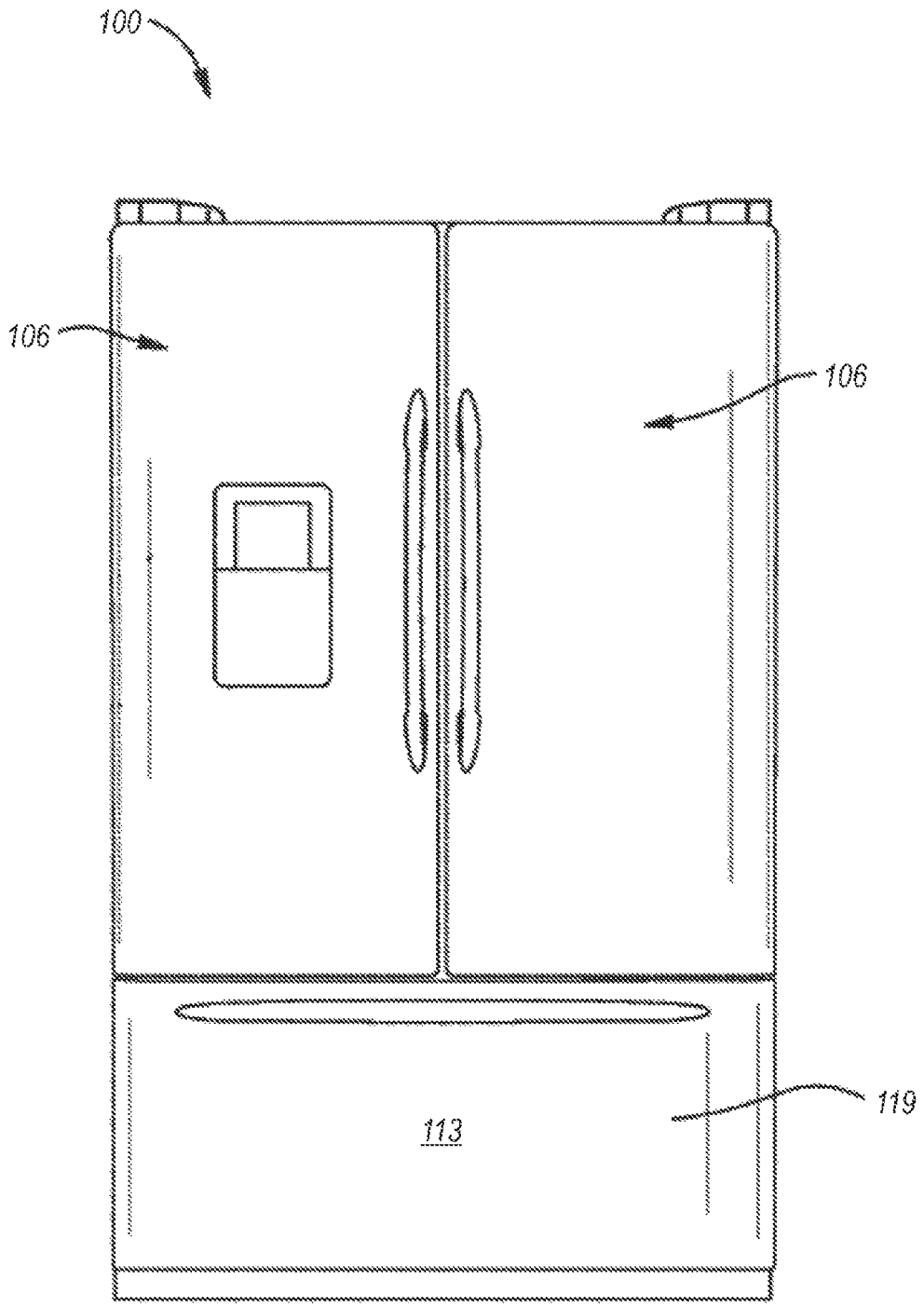
FIG. 1 illustrates a plan view of an exemplary French-Door Bottom Mount type refrigerator according to one or more embodiments.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" includes any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Refrigerators may generally include a number of different compartments that each attempt to maintain different temperatures. For example, ice makers or compartments that contain ice makers require cooler temperatures than another compartment where liquids or non-frozen food is stored. Compartments for ice makers are generally accessible by way of a dispenser that allows a user to dispense a desired amount of ice, for example for a beverage. Some ice makers include a removable tray or bin that a user may remove a relatively large quantity of ice to fill a cooler, for example. The removable tray or bin may be accessed by opening an access door, that when closed, conceals and attempts to mitigate heat transfer between the ice compartment and other portions of the refrigerator. Proper sealing between the access door and the portion of the refrigerator that houses the ice maker may improve efficiency of the refrigerator and may prevent a buildup in condensation within the ice compartment. When frozen, the condensation may accumulate and result in frost within the ice maker and freezer compartments or clumping of the ice stored therein.

Referring generally to the figures, a refrigerator 100 is provided. The refrigerator 100 may include a main body such as a cabinet 102 that may form a fresh food compartment 104. One or more doors 106 may be pivotally attached to the cabinet 102 and the doors 106 may be configured to pivot about the cabinet 102 between an open position and a closed position. When the one or more doors 106 are in the open position, a user may access the fresh food compartment 104. As an example, an access door 108 may be attached the door 106 and the door 106 may include an ice maker compartment 110. The access door 108 may be pivotally attached to the door 106 so that the access door 108 is pivotable about the door 106 between an open position, to open the ice maker compartment 110, and a closed position to close the ice maker compartment 110.

In one or more embodiments, a sealing assembly 112 may be provided between the access door 108 and the door 106. The sealing assembly 112 may include a female sealing member 114 and a male sealing member 116. The female sealing member 114 may extend along portions of the access door 108 or the door 106 and the male sealing member 116 may extend along the other of the access door 108 or the door 106 so that when the access door 108 is in the closed position, the female sealing member 114 receives the male sealing member 116. As an example, portions of the door 106, such as a mating surface 120, extending around the ice maker compartment 110 may define a slot 138 that may receive the female sealing member 114. As another example, portions of the access door 108, may define the slot 138 and the male sealing member 116 may be disposed on the door 106 so that the male sealing member 116 engages the female sealing member 114 disposed in the slot.

Figure 3:
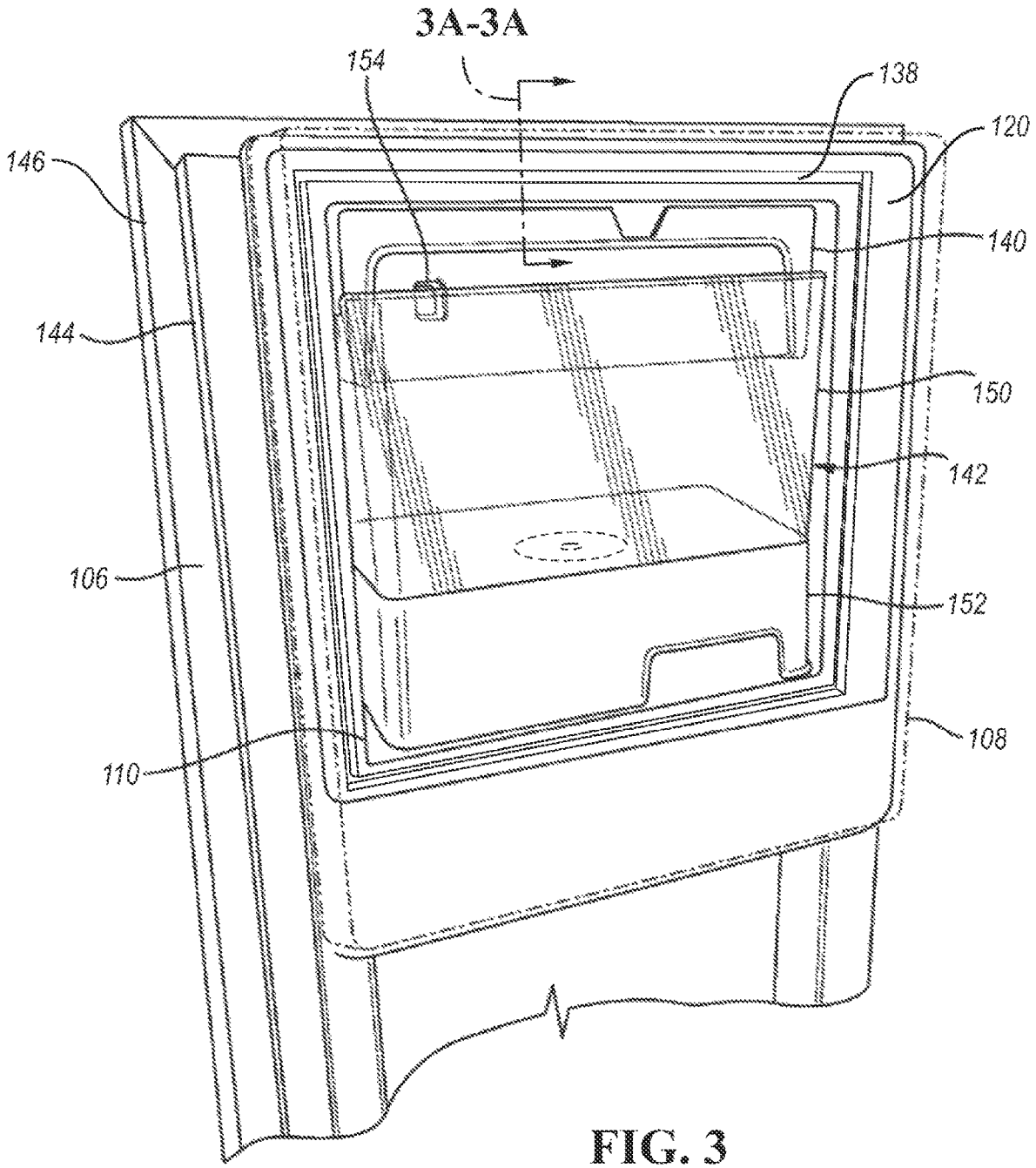
FIG. 3 illustrates a perspective view of the interior of one door of the refrigerator with the ice maker and ice container installed.
Figure 3A:
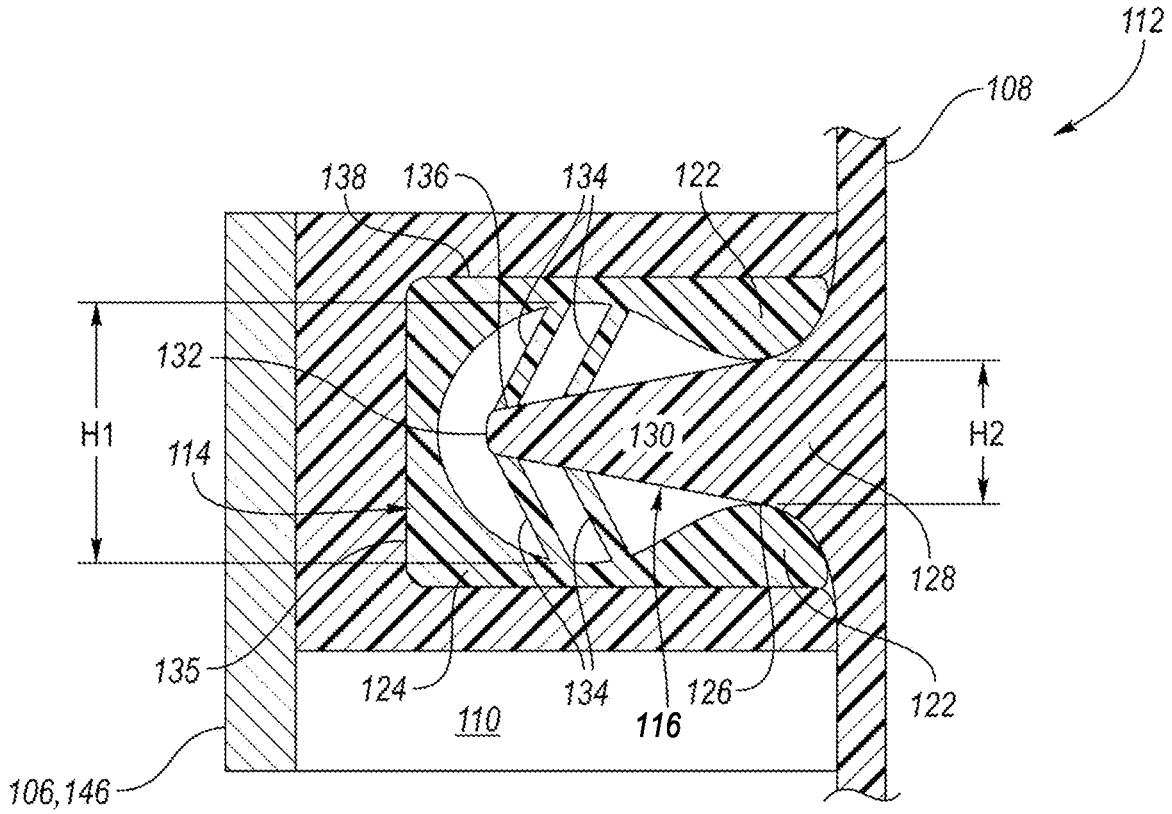
FIG. 3A illustrates a cross-sectional view taken along the lines 3A in FIG. 3.

FIG. 3A illustrates a cross-sectional view taken along the lines 3A in FIG. 3. The female sealing member 114 may be a gasket socket that may have an omega shape including a base 122 and a bulbous portion 124 that may extend from the base 122. As an example, the bulbous portion 124 may define a first height H1 and the neck may define a second height H2 that may be less than the first height H1. The base 122 may extend from the mating surface 120 to a neck 126 that may be curved from the base 122 the bulbous portion 124. The male sealing member 116 may include a male base portion 128 and a protrusion 130 that may extend from the male base portion 128 to a distal end 132. The protrusion 130 may be tapered between the male base portion 128 and the distal end 132. In other words, the distal end 132 may have a height that is less than a height of a portion of the protrusion that is connected to the male base portion 128. As the access door 108 is closed, the distal end 132 may move past the neck 126 into the bulbous portion 124.

The female sealing member 114 may have a height that is slightly less than a width of the slot 138 so that the female sealing member may be pressed into the slot 138. As an example, the female sealing member may be fixed within the slot by a press-fit or form-fit condition. Or an adhesive (not illustrated) may be provided on one of the inner walls of the slot 138 so that the female sealing member 114 is adhered to an inner periphery of the slot 138.

In one or more embodiments, the female sealing member 114 may include one or more vanes 134 that may extend from the protrusion 130. As an example, the vanes 134 may extend from the bulbous portion 124 towards the protrusion 130 so that a distal end 136 of the vane 134 contacts or engages the protrusion 130. The vanes 134 may be configured to deflect as the male sealing member 116 is inserted into the female sealing member 114. The vanes 134 may be disposed between a distal end 135 of the female sealing member 114 and the base 122 of the female sealing member to provide a layered seal.

The layered seal may mitigate heat transfer between relatively cool air, disposed within the ice maker compartment 110, and relatively warmer air surrounding the ice maker compartment 110. As an example, the vanes 134 and portions of the protrusion 130 may form a number of chambers to trap air therein and mitigate heat transfer between cold areas and warm areas of the refrigerator 100. As another example, the vanes 134 may be configured to trap air to prevent heat transfer from warmer air moving from outside the access door 108 to the ice maker compartment 110. The base 122 of the female sealing member 114 may also cooperate with one or more of the vanes 134 to form another chamber to mitigate heat transfer between warmer and cooler areas of the refrigerator. As an example, the base may have a semi-circular shape that is configured to engage the base portion 128 of the protrusion 130.

The male sealing member 116, such as the protrusion may be integrally formed to the access door 108. As an example, the access door may be formed by injection molding and the die may provide a recess to form the protrusion 130 as the remainder of the access door 108 is formed. As another example, the protrusion 130 may be separately formed from the access door 108. As such, the protrusion 130 may be adhered to the access door 108. Alternatively, the protrusion may be fixed to the access door 108 by one or more fasteners.

The female sealing member 114 and the male sealing member 116 may each be formed by one or more polymeric materials. As an example, the female sealing member 114 may be formed by a plastic material, such as polyvinyl chloride (PVC) having an elongation at break of approximately 20-40%. The male sealing member 116 may be formed by a more rigid or less elastic material than the material of the female sealing member 114. As an example, the male sealing member 116 may be formed by having an elongation at break of approximately 20-40%. Because the male sealing member 116 or more specifically, the protrusion 130 is more rigid than the female sealing member 114, the protrusion may bend or deflect the vanes 134 as the protrusion 130 is inserted into the female sealing member 114.

Figure 2:
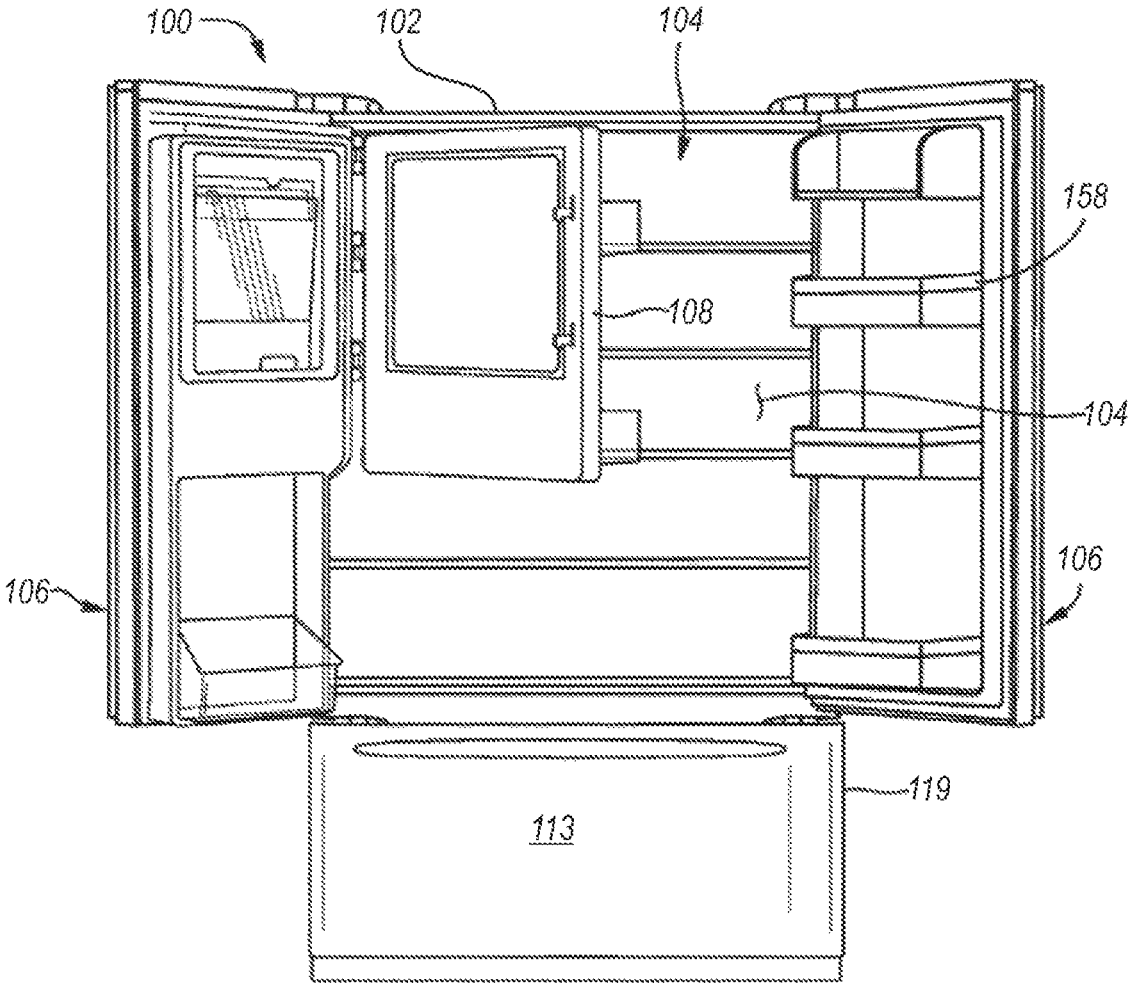
FIG. 2 illustrates a plan view of an elevated front view of a French-Door Bottom Mount type refrigerator with the refrigerator compartment doors open refrigerator shown in FIG. 1.

FIG. 1 generally shows the refrigerator 100. The refrigerator may be of the French-Door Bottom Mount type, but it is understood that this disclosure could apply to any type of refrigerator, such as a side-by-side, two-door bottom mount, or a top-mount type. As shown in FIGS. 1-2B, the refrigerator 100 may have a first internal storage chamber or the fresh food compartment 104 configured to refrigerate and not freeze consumables within the fresh food compartment 104, and a second internal storage chamber or a freezer compartment 113 configured to freeze consumables within the freezer compartment 113 during normal use. The refrigerator 100 includes cabinet walls that define the fresh food compartment 104 and the freezer compartment 113. The refrigerator 100 may have one or more doors 106, 119 that provide selective access to the interior volume of the refrigerator 100 where consumables may be stored. As shown, the fresh food compartment doors are designated 106, and the freezer door is designated 119. It may also be shown that the fresh food compartment 104 may only have one door 106.

In one or more embodiments, the female sealing member 114 and the male sealing member 116 may each be disposed between the freezer door 119 and the cabinet. The female sealing member 114 may be disposed on an inner surface of the freezer door 119 and the male sealing member 116 may be disposed on portions of the cabinet 102. As another example, the male sealing member 116 may be disposed on an inner surface of the freezer door 119 and the female sealing member 114 may be disposed on portions of the cabinet 102.

It is generally known that the freezer compartment 113 is typically kept at a temperature below the freezing point of water, and the fresh food compartment 104 is typically kept at a temperature above the freezing point of water and generally below a temperature of from about 35° F. to about 50° F., more typically below about 38° F. As shown in FIGS. 2-3, an ice maker 140 may be located on a door 106 to the refrigerated fresh food compartment 104. The ice maker 140 may be formed by an assembly of a bracket, a motor, an ice tray, a bail arm connected to the motor, at least one wire harness and at least one thermistor. An ice maker, such as the ice maker 140, is disclosed in U.S. patent application Ser. No. 16/872,690 filed on May 12, 2020, which is incorporated by reference herein in its entirety. The door 106 may include the ice maker 140 and the access door 108 pivotally connected to one of the doors 106 of the refrigerator 100 at a vertical edge closest to the cabinet. The hinge may be a single or multiple hinge(s) and may be spaced along the entire edge, substantially the entire edge, or more frequently, two hinges may be used with one near the top edge of the access door 108 and one close to the bottom edge of the access door 108.

In one or more embodiments, the access door 108 may be configured to translate with respect to door 106 between an open position and a closed position. One or more tracks or guides (not illustrated) may extend from the door 106 and the access door 108 may move e.g., translate along the tracks.

Due at least in part to the access door 108 and the design and size of the ice maker 140, the access door 108 has a peripheral edge liner that extends outward from the surface of the access door 108 and defines a dike wall. The dike walls extend from at least the two vertical sides, more typically all four sides and define a door bin receiving volume along the surface of the access door 108. The access door 108 is selectively operable between an open position, in which the ice maker 140 and the ice storage container or bin 142 are accessible, and a closed position, in which the ice maker 140 and the ice storage bin 142 are not accessible. The access door 108 may also include door bins 158 that are able to hold smaller food items. The door bins 158 may also be located on or removably mounted to the access door 108 and at least partially spaced within the door bin receiving volume of the access door 108. While not typically the case, the ice maker 140 may also be located exterior the fresh food compartment 104, such as on top of the refrigerator cabinet, in a mullion between the fresh food compartment 104 and the freezer compartment 113, in a mullion between two fresh food compartments 104, or anywhere else an automatic motor driven ice maker 140 may be located.

The refrigerator 100 may also have a duct or duct system (not shown) with an inlet in the freezer compartment 113 and an outlet in the fresh food compartment 104. The duct may be situated such that the length of the duct necessary to direct air from the freezer compartment 113 to the fresh food compartment 104 is minimized, reducing the amount of heat gained in the travel between the inlet and the outlet. The duct outlet located in fresh food compartment 104 may be positioned at a location near the ice maker 140. The refrigerator 100 may also have one or more fans, but typically has a single fan (not shown) located in the freezer compartment 113 to force air from the freezer compartment 113 to the fresh food compartment 104. The colder air from the freezer compartment 113 is needed in the ice maker 140 because air below the freezing point of water is needed to freeze the water that enters the ice maker 140 to freeze into ice cubes. In the embodiment shown, the ice maker 140 is located in the fresh food compartment 104, which typically holds air above the freezing point of water.

In various embodiments, where the ice maker 140 is located in a compartment or location other than in the freezer compartment 113, a fan is needed to force the air to the ice maker 140. In other embodiments, the fan or fans may be located either in the freezer compartment 113, the fresh food compartment 104, or in another location where the fan is able force air through the duct. The ice maker 140 is often positioned within a door of the refrigerator 100 to allow for delivery of ice through the door 106 in a dispensing area on the exterior of the refrigerator 100, typically at a location on the exterior below the level of the ice storage bin 142 to allow gravity to force the ice down an ice dispensing chute into the refrigerator door 106. The chute extends from the bin to the dispensing area and ice is typically pushed into the chute using an electrical power-driven auger. Ice is dispensed from the ice storage bin 142 to the user of the refrigerator 100.

The refrigerator 100 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 100 may also have a control board or controller that sends electrical signals to the one or more valves when prompted by a user that water is desired or if an ice making cycle is required.

FIG. 3 shows a closer view of a door 106 with the access door 108 in hidden lines to show the ice maker 140. The door 106 may have an inner liner 144 that is secured to an outer panel 146. The inner liner 144 is disposed on an internal side of the outer panel 146 and defines an ice maker compartment 110 in which the ice maker 140 and an ice storage bin 142 of the ice maker assembly are disposed. The ice maker compartment 110 may be referred to a cavity or receptacle that is defined by the inner liner 144 and is configured to receive the ice storage bin 142. The inner liner 144 may define the slot 138 that circumferentially extends around the ice maker compartment 140.

In some embodiments, the mating surface 120 may be formed by the outer panel 146. As another example, the slot 138 may extend into the inner liner 144 and at least portions of the outer panel 146. As described above, the slot 138 may be configured to receive the female sealing member 114. In other words, the width, depth, and length of the slot 138 may be collectively configured to receive the female sealing member 114. For the purpose of clarity, the female sealing member 114 is not shown in this view. However, the female sealing member 114 is shown in the cross-sectional view illustrated in FIG. 3A. The slot 138 may be positioned with respect to the male sealing member 116 so that the protrusion 130 extends into the female sealing member 114 when the access door 108 is in the closed position.

The ice storage bin 142 may be removably positioned within the ice maker compartment 110 (i.e., the ice storage bin 142 may be inserted into or removed from the ice maker compartment 110). The ice maker 140 may be located at an upper portion of the ice maker compartment 110. The ice storage bin 142 may be located below the ice maker 140 such that as ice is harvested, the ice maker 140 uses gravity to transfer the ice from the ice maker 140 to the ice storage bin 142. The ice storage bin 142 may include an ice bin base 152 and one or more ice bin walls 150 that extends upwardly from the perimeter of the ice bin base 152.

The ice maker 140 may include an on/off switch 154. The on/off switch 154 may be located on the ice maker 140 in a location that is accessible to a user without removing the ice maker 140 from the door 106 or the refrigerator 100. The ice bin wall 150 may be configured such that when the ice storage bin 142 is placed in the door 106, the on/off switch 154 is inaccessible to the user, and when the ice storage bin 142 is removed from the door 106, the on/off switch 154 is accessible to a user. The ice storage bin wall 150 may be made of a clear plastic material such as a copolyester so that a user can see the on/off switch 154 even while inaccessible when the ice storage bin 142 is in place. However, the front portion of the ice bin wall 150 typically extends to cover the on/off switch 154 when in the installed position to prevent inadvertent actuation of the on/off switch 154. The front portion of the ice bin wall 150 also typically extends upward to form a lip that extends around at least a portion of the ice maker 140 to further retain ice.

The ice maker 140, the door 106 (or more specifically, the portions of the door 106 that define the ice maker compartment 110), and the ice storage bin 142 may collectively be referred to as an ice maker assembly. The door 106 (or more specifically, the portions of the door 106 that define the ice maker compartment 110) and the ice storage bin 142 may collectively be referred to as an ice bin assembly. Additional details of the physical attributes that may include the ice maker assembly and the ice bin assembly are disclosed in U.S. Pat. App. No. 106/872,690 filed on May 12, 2020, which is incorporated by reference herein in its entirety.

Figure 4:
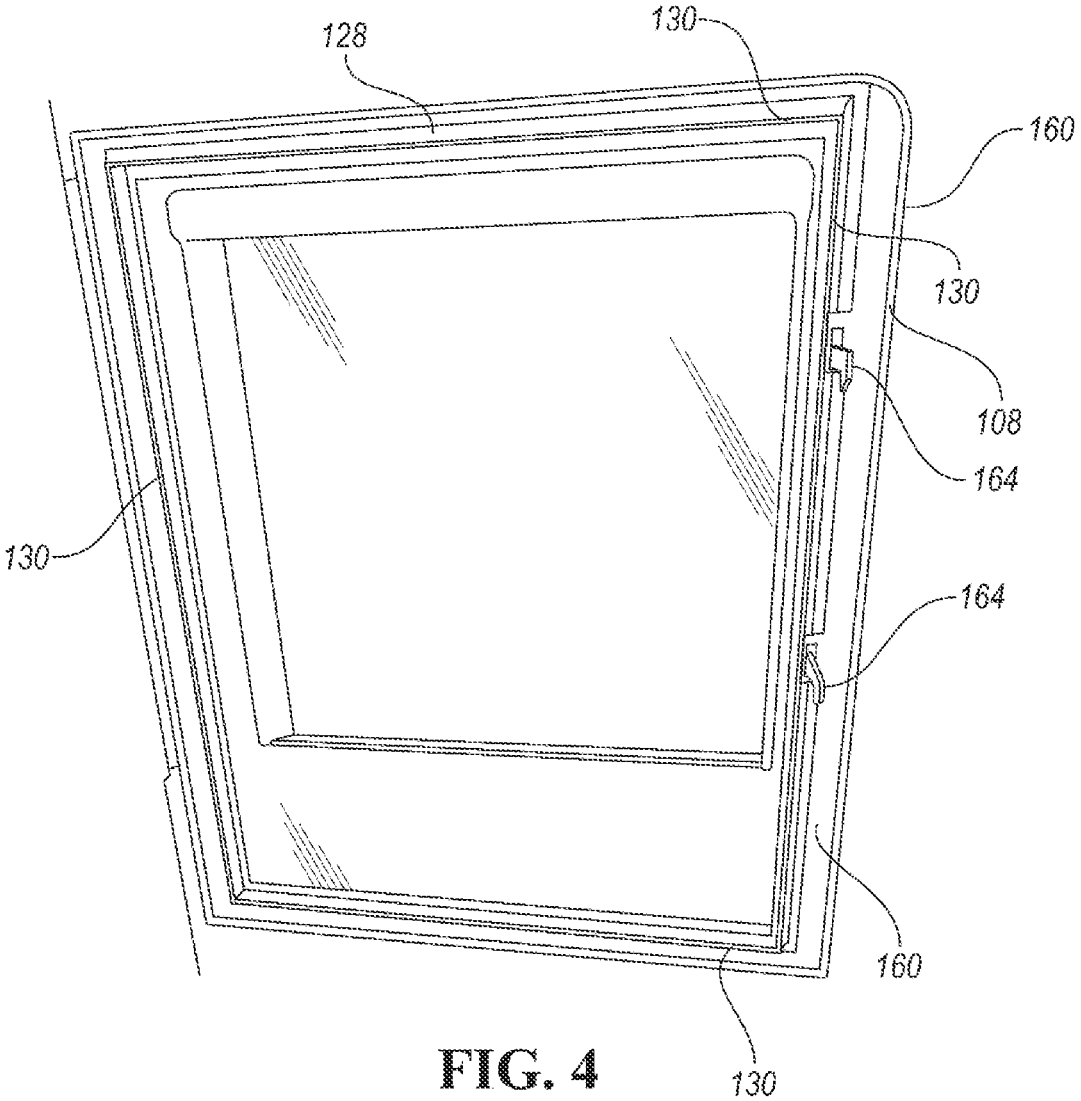
FIG. 4 illustrates a perspective view of an exemplary access door in an open position.

FIG. 4 illustrates a closer view of the access door 108. The access door 108 may include an inner surface 160, that faces the fresh food compartment 104, and an outer surface 162 that may face the ice maker compartment. As stated above, the protrusion 130 may include the base 128 that may be integrally formed e.g., formed in one piece, with or to the outer surface 162 of the access door 108. The protrusion 130 may extend from the base 128 to the distal end 132 (FIG. 3A). The protrusion 130 may be positioned along portions of the outer surface 162 so that the distal end 132 is substantially aligned with the slot 138, the female sealing member 114, or both.

In one or more embodiments, a liner may be disposed within an inner periphery of the protrusion 130. Such a liner may also extend beyond the inner periphery of the protrusion. The access door 108 may include one or more latches 164 may be provided on the access door, such as on the outer surface 162. The latches 164 may be configured to engage one or more apertures or locking features (not illustrated) defined by or disposed on portions of the door 106, such as the inner liner 144 or outer panel 146 or both.

As an example, the slot 138 may be defined by the outer surface 162 of the access door 108. If the outer surface 162 of the access door 108 defines the slot 138, the male sealing member 116 may be disposed on the door 106 or the inner liner 144. In one or more embodiments, the protrusion 130 of the male sealing member 116 may be integrally formed to the inner liner 144.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A refrigerator comprising:

a body (i) defining a refrigerated compartment and (ii) having a first exterior mating surface;

a door (i) configured to move about the body between an open position, in which the refrigerated compartment is open, and a closed position in which the refrigerated compartment is closed and (ii) having a second exterior mating surface configured to be positioned opposite to the first mating surface when the door is in the closed position, wherein one of the first exterior mating surface or the second exterior mating surface defines an inwardly extending slot;

a female sealing member disposed on and extending along one of the first exterior mating surface or the second exterior mating surface and within the slot; and a male sealing member disposed on and extending along the other of the first exterior mating surface or the second exterior mating surface, wherein (i) the female sealing member is configured to receive and engage with the male sealing member when the door is in a closed position to form a seal between the refrigerated compartment and surroundings external to the refrigerated compartment and (ii) the male sealing member is configured to disengage the female sealing member when the door is in the open position to break the seal between the refrigerated compartment and the surroundings external to the refrigerated compartment.

2. The refrigerator of claim 1, further comprising:

an ice maker assembly disposed in the refrigerated compartment and configured to freeze water and produce ice.

3. The refrigerator of claim 1, wherein the first exterior mating surface of the body extends circumferentially about the refrigerated compartment.

4. The refrigerator of claim 1, wherein the female sealing member includes a gasket socket disposed in the slot.

5. The refrigerator of claim 4, wherein the gasket socket includes a bulbous portion and a neck, wherein the bulbous portion has a first height and the neck has a second height, wherein the first height is greater than the second height.

6. The refrigerator of claim 5, wherein the gasket socket includes a vane extending from the bulbous portion and configured to engage the male sealing member.

7. The refrigerator of claim 1, wherein the male sealing member is formed by a base lying along the second exterior mating surface of the door and a protrusion extending therefrom to a distal end, wherein the protrusion is tapered between the base and the distal end.

8. The refrigerator of claim 7, wherein the base is integrally formed to the door.

9. A refrigerator comprising:

a main body defining a first refrigerated compartment;

a first door (i) defining a second refrigerated compartment, (ii) configured to move with respect to the main body, and (iii) having a first exterior mating surface;

a second door (i) configured to move with respect to the first door between an open position, in which the second refrigerated compartment is accessible, and a closed position in which the second refrigerated compartment is inaccessible and (ii) having a second exterior mating surface configured to be positioned opposite to the first mating surface when the second door is in the closed position, wherein one of the first exterior mating surface or the second exterior mating surface defines an inwardly extending slot;

a female sealing member disposed on and extending along one of the first exterior mating surface or the second exterior mating surface and within the slot; and a male sealing member disposed on and extending along the other of the first exterior mating surface or the second exterior mating surface, wherein (i) the male sealing member is at least partially disposed in and engages the female sealing member when the second door is in a closed position to form a seal between the first refrigerated compartment and the second refrigerated compartment and (ii) the male sealing member disengages the female sealing member when the second door is in the open position to break the seal between the first refrigerated compartment and the second refrigerated compartment.

10. The refrigerator of claim 9, wherein the female sealing member is formed by a gasket socket having an omega shape including a base and a bulbous portion extending therefrom.

11. The refrigerator of claim 10, wherein the male sealing member is formed by a tapered protrusion.

12. The refrigerator of claim 11, wherein when the second door is in the closed position, a distal end of the tapered protrusion is disposed in the bulbous portion.

13. A sealing assembly for use in a refrigerator provided with a body and a door configured to pivot about the body between an open position and a closed position, the sealing assembly comprising:

a gasket socket disposed (i) along a first exterior mating surface on an ice making storage assembly that is disposed within the body and (ii) within a slot that is defined by and extends inward from the first exterior mating surface; and a gasket protrusion fixed to a second exterior mating surface on the door, wherein (i) the second exterior mating surface is configured to be positioned opposite to the first mating surface when the door is in the closed position, (ii) the gasket protrusion is configured to engage and be at least partially disposed within the gasket socket when the door is in the closed position to form a seal between a refrigerated compartment defined by the ice making storage assembly and surroundings external to the ice making storage assembly, and (iii) the gasket protrusion is configured to disengage the gasket socket when the door is in the open position to break the seal between the refrigerated compartment and the surroundings external to the ice making storage assembly.

14. The sealing assembly of claim 13, wherein the gasket socket has an omega shape including a base and a bulbous portion extending therefrom.

15. The sealing assembly of claim 14, wherein the base forms a first end of the gasket socket and the bulbous portion forms a second end of the gasket socket, wherein the gasket socket includes a number of vanes each disposed between the first end and the second end.

16. The sealing assembly of claim 15, wherein each of the vanes extend from an inner periphery of the bulbous portion.

17. The sealing assembly of claim 13, wherein the gasket socket is formed by a first material having a first elasticity and the gasket protrusion is formed by a second material having a second elasticity, wherein the second elasticity is less than the first elasticity.

18. The sealing assembly of claim 17, wherein the first material is polyvinyl chloride.

19. The sealing assembly of claim 18, wherein the second material is Acrylonitrile butadiene styrene.

* * * * *